US006155566A

United States Patent [19]

Benatti

[11] Patent Number: 6,155,566

[45] **Date of Patent: *Dec. 5, 2000**

[54] BOARD GAME AND METHOD OF PLAY THEREFOR

[76] Inventor: Victor Martin Benatti, 330 E. Chestnut St., Apt 207B, Oxford, Ohio 45056

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,704

[22] Filed: Dec. 17, 1997

[51] Int. Cl.[7] ..... A63F 3/02

[52] U.S. Cl. ..... 273/263; 273/266

[58] Field of Search ..... 273/266, 263, 273/260, 261, 236

[56] References Cited

U.S. PATENT DOCUMENTS

| | | | |
|---|---|---|---|
| 511,773 | 1/1894 | Higgins | 273/261 |
| 1,509,678 | 9/1924 | MacPherson et al. . | |
| 1,554,022 | 9/1925 | Nelson | 273/263 |
| 1,562,025 | 11/1925 | Killman | 273/263 |
| 1,867,730 | 7/1932 | Christiansen | 273/263 |
| 3,708,171 | 1/1973 | Kunik et al. | 273/266 |
| 3,767,202 | 10/1973 | Sternad . | |
| 3,880,429 | 4/1975 | Blumenaus . | |
| 4,083,564 | 4/1978 | Matsumoto . | |
| 4,456,261 | 6/1984 | Daltzman . | |
| 4,991,855 | 2/1991 | Hazlewood . | |
| 5,306,015 | 4/1994 | Daud et al. | 273/263 X |
| 5,490,675 | 2/1996 | Persidsky et al. . | |
| 5,657,990 | 8/1997 | Patel | 273/263 |

OTHER PUBLICATIONS

Shari Lewis, "Shari Lewis Presents 101 Games and Songs," 1993, ISBN 0–679–92271–9, p. 36.

Robert McConville, "The History of Board Games," 1974, ISBN 0–88488–009–5, p. 69.

*Primary Examiner*—Sam Rimell

*Attorney, Agent, or Firm*—Bruce P. Bardes

[57] ABSTRACT

A board game for two players, including the apparatus and method of play, is described. The playing board is comprised of two substantially identical playing areas. Play comprises picking up playing pieces from one playing area and distributing them onto the other playing area, according to the rules of the game. The two players play in turn. The winner of the game is the player who forces the other player to move the last playing piece from one playing area to the other. The game is simple to learn, quick to play, and yet challenging for players of superior intelligence.

18 Claims, 4 Drawing Sheets

BOARD GAME AND METHOD OF PLAY THEREFOR

BACKGROUND OF THE INVENTION

1. Field of the Invention

This invention pertains generally to board games, and in particular to apparatus and methods of play therefor. Specifically, this invention pertains to a board game comprising a playing board, a plurality of playing pieces and a method of play, or Rules of the Game, therefor.

2. Description of Related Art

Board games have enjoyed wide popularity for many centuries, for they combine intellectual challenge, socialization and food for the competitive spirit. Many different types of board games have been invented. For example, some board games involve the movement of playing pieces along one or more paths identified on the playing board, according to the rules of the game. Monopoly (©Parker Brothers Division of General Mills Fun Group, Inc.) and Trivial Pursuit (©Horn Abbot Ltd.) are such games. Other board games involve the movement of playing pieces by the players between playing positions, according to rules of the game. Chess, checkers, Chinese checkers, and backgammon are such games. In some games, such as Scrabble (©Production and Marketing Company), Othello (©Gabriel Industries, Inc.) and kalah, playing pieces may be distributed to the playing board by the players during the course of play; in others, such as chess, playing pieces may be removed from the playing board by the players during the course of play. Other games, such as Nim, are readily played on any horizontal surface, but are conveniently described as board games because of the character of play. The board game of the present invention differs from other classes of board games, because it provides for removing playing pieces from one area of the playing board and then distributing those playing pieces in a different area of the playing board; each move by a player demands separate, but related, tactics for removing and distributing the playing pieces. The board game of the present invention also differs from other board games in that all playing pieces are identical, rather than being of different colors to indicate which player they belong to, and in that pieces are not captured during play.

OBJECTS OF THE INVENTION

One object of the present invention to provide a board game that is intellectually challenging, even to players of superior intelligence.

A second object of the invention is to provide a board game that is simple enough to be played by children.

Another object of the invention is to provide a board game that requires relatively simple apparatus.

Yet another object of the invention is to provide a board game that can be played quickly, enabling the players to complete a game within about five minutes.

Still another object of the invention is to provide a board game that admits to variations in the method of play, to provide the players with variety in the game.

A further object of the invention is to provide a game that admits to playing on a computer, either as one player against the computer, or two players against each other, wherein the computer provides apparatus for the game.

BRIEF DESCRIPTION OF THE INVENTION

The preceding Objects of the Invention are achieved in accordance with the following features of the present invention. The board game of the present invention provides for playing apparatus, comprising a playing board and playing pieces, and a method of play therefor, termed Rules of the Game. The playing apparatus and the Rules of the Game were each developed in conjunction with the other, and the two are inseparable.

The playing board comprises two playing areas, and during the course of play, a player picks up one or more playing pieces from one playing area and distributes the same pieces to the other playing area. Each playing area comprises at least three rows of playing positions. A central row of playing positions contains at least one playing position. Adjacent rows contain at least one more playing position than the central row, or the adjacent row nearer to the central row. Each playing position is identified on the surface of the playing board, by a color differing from the remainder of the board, a depression in the surface of the board, or by other suitable means. The arrangement of playing positions and rows is symmetrical about the central row, and the same in the two playing areas. Lines, grooves, ridges or other suitable means are used to identify which playing positions are deemed proximate to other nearby playing positions. A sufficient number of playing pieces to occupy each playing position in one playing area is also provided.

The invention also includes providing each playing position with means for securing a playing piece in that playing position, to resist inadvertent movement of the playing pieces.

The present invention additionally comprises several variations in the configuration of the playing board, the number of playing pieces, and the Rules of the Game.

DETAILED DESCRIPTION OF THE INVENTION

Figure 1:
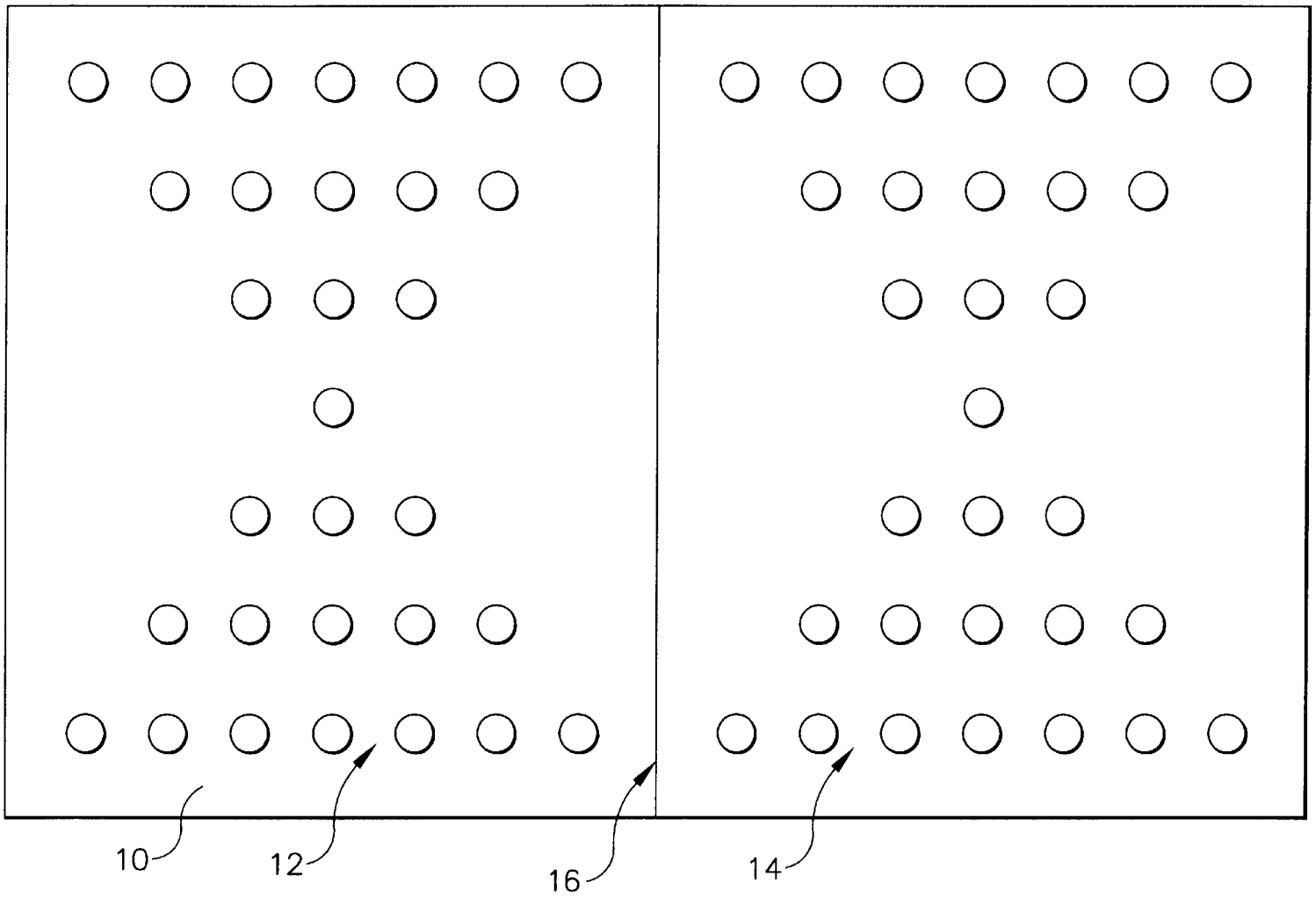
FIG. 1 is a schematic diagram of the playing board, showing the two playing areas.

The board game of the present invention is conveniently described with reference to the drawings. The general arrangement of the playing board is illustrated in FIG. 1. The playing board, shown generally as 10, is provided with two playing areas, shown at 12 and 14. The playing areas are comprised of rows of playing positions, as shown in greater detail in FIGS. 2 and 3. The two playing areas are substantially identical in terms of the number and relative locations of the playing positions in each. However, within the scope of the present invention, the two playing areas may differ in color, or some other nonfunctional aesthetic manner, to enhance the appearance of the game board. If desired, the playing board may be constructed to be folded along a hinge in the board, shown at 16.

Figure 2:
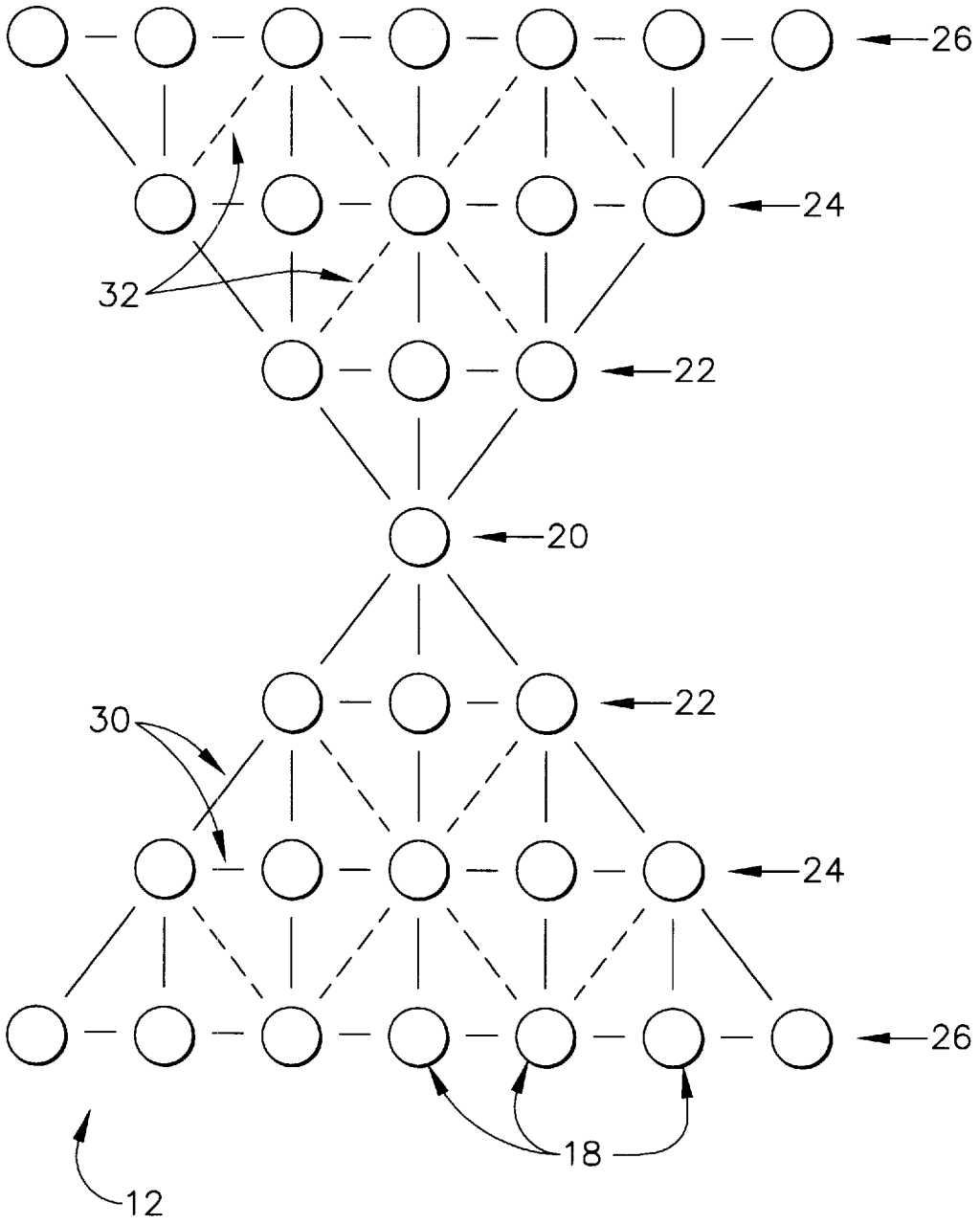
FIG. 2 is a detailed diagram of one playing area, showing the relative locations of playing positions in one embodiment of the invention.

FIG. 2 illustrates the relative locations of playing positions in a playing area in one embodiment of the invention. The playing positions, represented by circles and shown generally at 18 in FIG. 2, are arranged in rows, shown at

20–26. The playing positions may take any form that identifies them as such on the surface of the playing board. Some of the forms of identifying playing positions, as contemplated in the present invention, are: regions of contrasting color on the playing board; shallow depressions in the surface of the playing board; holes cut at least partially through the thickness of the playing board; pads of Velcro™ attached to the surface of the playing board; and pockets, preferably of a transparent material, attached to the surface of the playing board. Playing positions could also be identified by attaching a piece of magnetic material to the underside of the playing board at each playing position.

The playing positions are arranged in rows, shown at 20–26 in FIG. 2. There is a central row, shown at 20, comprising at least one playing position. In this drawing, the central row contains exactly one playing position. There are two first adjacent rows, shown at 22, disposed parallel to the central row and on opposite sides of the central row. Each first adjacent row comprises at least one more playing position than the central row. In its simplest form, the board game of the present invention comprises only the central row and the two first adjacent rows, but such a game would not present much challenge to the players. There may be two second adjacent rows, shown at 24. The second adjacent rows are disposed parallel to the first adjacent rows, in a direction away from the central row, and each second adjacent row comprises at least one more playing position than a first adjacent row. There may also be two third adjacent rows, shown at 26. The third adjacent rows are disposed parallel to the second adjacent rows, in a direction away from the central row, and each third adjacent row comprises at least one more playing position than a second adjacent row. In this drawing, each first adjacent row comprises two more playing positions than the central row, and each second adjacent row comprises two more playing positions than a first adjacent row, and so on. This arrangement of rows necessarily produces an odd number of rows in each playing area. For esthetic reasons, and to facilitate play, the rows are preferably uniformly spaced, and disposed symmetrically about the central row. The playing positions, shown at 18, are represented by circles. This does not imply that the playing positions and the playing pieces are necessarily circular in shape. In fact, in one form contemplated for the present invention, the playing pieces are substantially rectangular solids and the playing positions are mating rectangular depressions in the playing board. Any other desired shape may be used, within the intended scope of the present invention.

The location of each playing position is related to the location(s) of one or more other playing positions by some convenient visual or tactile means. A simple means for identifying such relationships is a line of contrasting color on the surface of the playing board, shown at 30, and the term line is used herein to encompass all such means. Other appropriate means contemplated in the present invention include grooves or raised ridges on the surface of the playing board. Either of these means could be combined with contrasting color to identify the relationship between playing positions. If desired, additional lines, shown by dashed lines, at 32, may be employed. The lines on the surface of the playing board are essential to the play of the game, for they serve to identify which playing pieces may be picked up by a player during a move.

Playing pieces may be any desired shape and size that admits to being conveniently picked up by the players during play. Also, they are preferably designed to mate with the playing positions. For example, if the playing positions are identified by "loop" type pads of Velcro, the playing pieces should have "hook" type pads of Velcro attached to their bottom surfaces. The use of Velcro, magnets, or depressions on the surface of the playing board allows the playing pieces to remain where placed by the players, avoiding unintentional movement should the playing board be accidentally moved during play. For the board game illustrated in FIG. 2, 31 playing pieces are required.

Figure 3:
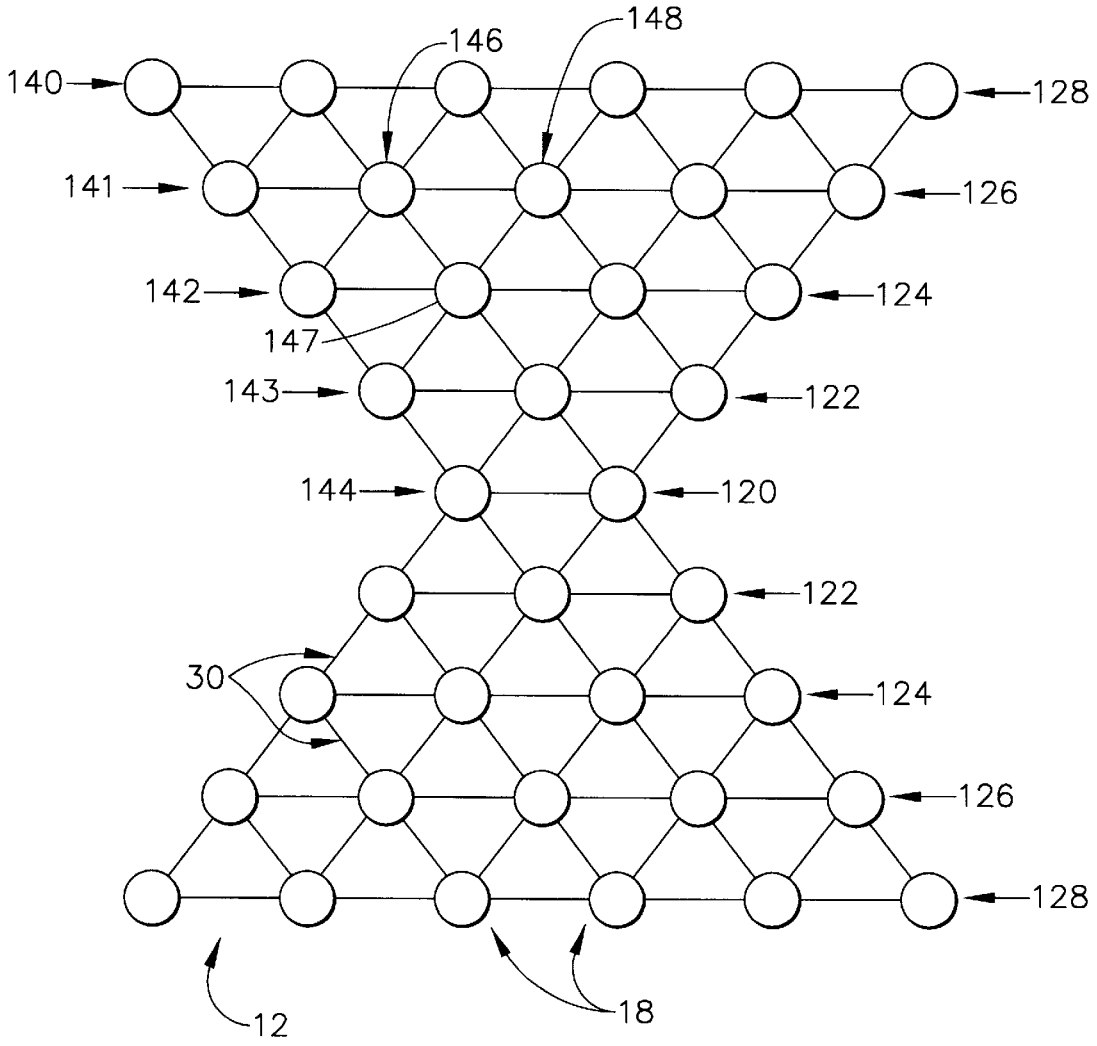
FIG. 3 is a detailed depiction of one playing area, showing the relative locations of playing positions in an alternative embodiment of the invention.

An alternative form of the invention is shown if FIG. 3. In this form, a playing area is shown at 12. The playing positions, shown at 18, arranged in rows 120–128. The central row, shown at 120, comprises two playing positions. The first adjacent rows, shown at 122, each comprise one more playing position than the central row. Similarly, the second adjacent rows, shown at 124, each comprise one more playing position than the first adjacent rows. In this form of the invention, there are third and fourth adjacent rows, shown at 126 and 128, respectively. Lines, shown at 30, identify the relationships between playing positions. Numerous other forms of the invention, fully within the spirit and intent of the present invention, could be devised.

Figure 4:
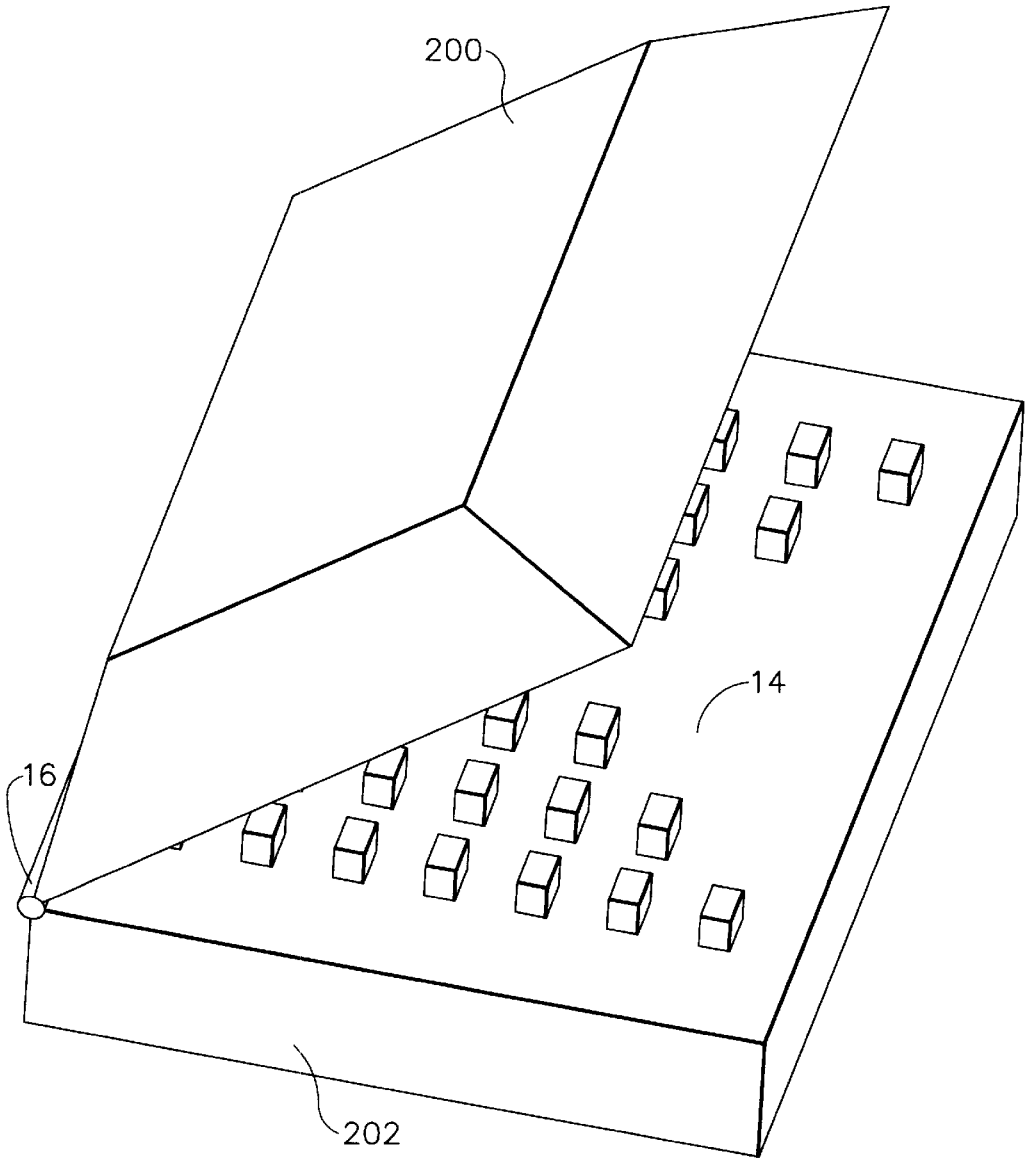
FIG. 4 is a schematic diagram of a folding playing board, wherein the playing board is enclosed within a case.

The board game of the present invention may be enclosed within a case, as illustrated in FIG. 4. In this mode, the playing board and playing pieces are conveniently stored within the protective case, to avoid loss or damage. In this form of the invention, the case is comprised of two halves, shown at 200 and 202, which are hinged along one edge, shown at 16. One playing area, shown at 14, is built into one half of the case, shown at 202. There is another playing area, not shown, built into the other half of the case, shown at 200. In the form of the invention illustrated in FIG. 4, the shape of the case, when closed, is similar to that of the playing pieces, only larger. This may be done for esthetic reasons.

The nature of the game admits to playing on a computer. One player may compete against a computer, or two players may use the computer in lieu of a playing board. In the latter case, the playing board and playing pieces may be displayed on a video display, such as a cathode ray tube, while the computer keeps track of the location of each playing piece. A player could use an input device such as a mouse or joystick to tell the computer which pieces are to be moved, and to which new playing positions. If the computer has been programmed with suitable algorithms to respond to a player's moves, the player would be competing against the computer.

The apparatus for the board game of the present invention, illustrated in the drawings, and defined by the appended Claims, was devised concurrently with a method for playing the game. It is the intent of the inventors that the apparatus and method be inseparable. The method for playing the game may be termed Rules of the Game.

One term used in the Rules of the Game warrants specific definition. That term is proximate. As applied to playing pieces, the term proximate means two playing pieces located in playing positions connected by a line on the playing board. The term proximate may also mean three or more playing pieces, provided that their respective playing positions are connected by collinear lines, and that there are no vacant playing positions between any two playing pieces. With respect to playing positions, the term proximate means two or more playing positions connected by collinear lines on the playing board, none of which are occupied by playing pieces. The concept of proximate playing pieces is illustrated in FIG. 3. Assume that playing positions 140 through 144 are all occupied by playing pieces. Then the playing pieces in playing positions 140 and 141 would be proximate.

So would be the playing pieces in playing positions 142, 143 and 144. So would be the playing pieces in playing positions 141, 142, 143 and 144. So would be the five playing pieces in playing positions 140 through 144. However, if playing position 142 were vacant, the only possible combinations of proximate playing pieces would be 140 and 141, and 143 and 144. If playing position 143 were occupied, then playing positions 140, 141 and 142 would be proximate. With respect to playing positions 140 through 144, playing position 148 could be proximate only with playing position 141 (if playing position 146 were vacant) or playing position 143 (if playing position 147 were vacant).

The Rules of the Game are as follows:

a. This is a game for two players, one of whom may be a computer;

b. To start the game, one playing piece is placed in each playing position of one playing area, which is termed the starting area;

c. One of the players, selected by chance, begins play by picking up at least one playing piece from the starting area, subject to the provision that all playing pieces picked up were located in proximate playing positions, and placing those playing pieces in the other playing area, termed the finishing area, subject to the provision that all such playing pieces be placed in proximate playing positions, thereby completing a move;

d. In completing a move, a player need not pick up all proximate playing pieces;

e. After one player has completed a more, the other player makes a move;

f. The players continue to alternate moves, until one player forces the other to move the last playing piece from the starting area to the finishing area;

g. The player who forces the other player to move the last playing piece from the starting area is the winner.

Numerous variations in Rules of the Game are possible. For example, the players may remove one or more playing pieces from the starting area before beginning play. Alternatively, a player may declare a switch in lieu of a move, thereby interchanging the starting and finishing areas and reversing the direction of play. The number of switches that each player may declare during a game is desirably limited by agreement between players before beginning play.

Among the various board games known to the inventors, the game deemed most similar to that of the present invention is called Nim or Nim's Game. Twelve playing pieces are arranged on a tabletop in three rows, containing three, four and five playing pieces, respectively. A player may pick up any number of playing pieces from any one row. The object is to force the other player to pick up the last playing piece. A winning strategy for Nim is simple and foolproof, with the result that a player knowing that strategy can invariably win the game over one who does not. If both players know that strategy, the player playing first can invariably win the game. A game can easily be completed within one minute. Because it is so simple, it is generally regarded as a game for children, and it has been described in many books of games for children, such as that entitled "Shari Lewis Presents 101 Games and Songs for Kids to Play and Sing," published by Random House in 1993.

The board game of the present invention differs from Nim in several ways. One essential feature is that playing Nim consists entirely of picking up playing pieces, whereas each move made in the game of the present invention consists of two parts: picking up one or more playing pieces from the starting area during the first part of a move and placing those pieces in the finishing area during the second part of a move. It is expected that the players will use different strategies for the two parts of each move, which substantially increases the challenge of playing the game. Nim, like most other board games, has only one playing area. Other points of distinction are: (1) moves in Nim are confined to a single row, whereas moves in the game of the present invention may involve proximate playing positions in several rows; (2) in preferred forms of the present invention, each playing area is considerably more complicated than that of Nim; and (3) the playing areas are highly symmetrical.

A game that has a playing board somewhat similar to that of the present invention is Lau Kata Kati, which is described by Robert McConville in "The History of Board Games," published by Creative Publications, Inc. in 1974. The playing areas of the two games are generally similar in shape, but Lau Kata Kati has only one playing area. The rules of Lau Kata Kati require playing pieces of two different colors to identify which pieces belong to each player. Also the objective of Lau Kata Kati is to capture all of the opponent's pieces. Thus, it is clearly a different game from that of the present invention.

Two preferred forms of the present invention are those illustrated in FIGS. 2 and 3. The more preferred form is that illustrated in FIG. 2. These forms of the invention are complex enough to be challenging, yet simple enough to provide speedy games.

While only certain embodiments of the present invention have been described herein, and presented as illustrative examples, rather than as limitations, it will be apparent to those familiar with the art of board games that various changes in the apparatus and method of play can be incorporated without departing from the spirit of the present invention, as defined by the following claims.

We claim:

1. A board game comprising:

a plurality of playing pieces; and a playing board having discrete first and second playing areas delineated thereupon, wherein each playing area comprises:

a plurality of playing positions, arranged in at least five rows, comprising:

a central row consisting of at least one playing position, but not more than three playing positions, two first adjacent rows disposed parallel to and on opposite sides of the central row, said two first adjacent rows each consisting of the same number of playing positions, that number being at least one greater than, but not more than three greater than, the number of playing positions in the central row, and two second adjacent rows disposed parallel to the first adjacent rows, and in a direction away from the central row, said second adjacent rows each consisting of the same number of playing positions, that number being at least one greater than, but not more than three greater than, the number of playing positions in each first adjacent row;

means for identifying the location of each playing position within each playing area, means for relating the location of each playing position to the location of at least one other playing position in the same playing area such that those playing locations are defined as proximate playing locations;

wherein the first and second playing areas are symmetrical about their respective central rows and functionally identical;

and wherein said playing pieces are initially disposed only in playing positions within said first playing area such that a player may move at least one playing piece from said first playing area to said second playing area.

2. A board game, as recited in claim 1, wherein all of the playing pieces are functionally identical.

3. A board game, as recited in claim 1, wherein each playing position is provided with means for securing a playing piece in that playing position, so as to resist inadvertent movement.

4. A board game, as recited in claim 1, wherein the means for relating the location of each playing position to at least one other playing position in the same playing area comprises lines of contrasting color on the playing board.

5. A board game, as recited in claim 1, wherein the playing board is configured so that it may be folded.

6. A board game, as recited in claim 5, wherein the playing board is enclosed within a case.

7. A board game, as recited in claim 1, wherein the playing pieces, playing board, a method of play therefor and positions of the playing pieces on the playing board all exist as data within a computer, and wherein at least a portion of such data is displayed on output means.

8. A board game, as recited in claim 7, wherein the output means comprises a computer monitor.

9. A board game, as recited in claim 7, wherein the computer is programmed to play against a human opponent.

10. A board game, as recited in claim 1, wherein each playing area consists of:

a plurality of playing positions, arranged in at least seven rows, comprising:

a central row consisting of at least one playing position, but not more than three playing positions, two first adjacent rows disposed parallel to and on opposite sides of the central row, said two first adjacent rows each consisting of the same number of playing positions, that number being at least one greater than, but not more than three greater than, the number of playing positions in the central row, two second adjacent rows disposed parallel to the first adjacent rows, and in a direction away from the central row, said second adjacent rows each consisting of the same number of playing positions, that number being at least one greater than, but not more than three greater than, the number of playing positions in each first adjacent row; and two third adjacent rows disposed parallel to the second adjacent rows, and in a direction away from the central row, said third adjacent rows each consisting of the same number of playing positions, that number being at least one greater than, but not more than three greater than, the number of playing positions in each second adjacent row.

11. A board game, as recited in claim 1, wherein each playing area consists of:

thirty-one playing positions, arranged in seven rows, consisting of:

a central row consisting of one playing position, two first adjacent rows disposed parallel to each other and on opposite sides of the central row, said two first adjacent rows each consisting of three playing positions, two second adjacent rows disposed parallel to the first adjacent rows, and in a direction away from the central row, said second adjacent rows each consisting of five playing positions, and two third adjacent rows disposed parallel to the second adjacent rows, and in a direction away from the central row, said third adjacent rows each consisting of seven playing positions;

means for identifying the location of each playing position within each playing area; and means for relating the location of each playing position to the location of at least one other playing position in the same playing area such that those playing locations are defined as proximate playing locations.

12. A method of play for a board game comprising the following steps:

a) Providing board game apparatus comprising:

a plurality of playing pieces; and a playing board having discrete first and second playing areas delineated thereupon, wherein each playing area comprises:

a plurality of playing positions, arranged in at least five rows, comprising:

a central row consisting of at least one playing position, but not more than three playing positions, two first adjacent rows disposed parallel to and on opposite sides of the central row, said two first adjacent rows each consisting of the same number of playing positions, that number being at least one greater than, but not more than three greater than, the number of playing positions in the central row, and two second adjacent rows disposed parallel to the first adjacent rows, and in a direction away from the central row, said second adjacent rows each consisting of the same number of playing positions, that number being at least one greater than, but not more than three greater than, the number of playing positions in each first adjacent row;

means for identifying the location of each playing position within each playing area, means for relating the location of each playing position to the location of at least one other playing position in the same playing area such that those playing locations are defined as proximate playing locations;

wherein the first and second playing areas are symmetrical about their respective central rows and functionally identical;

b) Providing two players, one of whom may be a computer;

c) Placing each of the playing pieces to be utilized during play on a playing position within the first playing area;

d) Selecting a first player, who begins play by moving at least one playing piece from the first playing area, subject to the provision that all playing pieces to be moved must be located in proximate playing positions prior to moving, and placing all such playing pieces on playing positions on the second playing area, subject to the provision that all such playing positions in the second playing area are proximate and previously unoccupied, thereby completing a move;

e) Selecting a second player, who continues play by making a move;

f) Continuing play, during which the first player and the second player, in alternating turns, make moves until one player forces the other player to move the last remaining playing piece from the first playing area to the second playing area;

g) Declaring the winner to be the player who forces the other player to move the last playing piece from the first playing area.

13. A method of play for a board game, as recited in claim 12, wherein a playing piece is placed on each playing position of the first playing area.

14. A method of play for a board game, as recited in claim 12, wherein the method of play, the playing pieces, the playing board and the positions of the playing pieces on the playing board all exist as data stored within a computer, and wherein at least a portion of such data is displayed on output means.

15. A method of play for a board game, as recited in claim 14, wherein the output means comprises a computer monitor.

16. A method of play for a board game, as recited in claim 12, wherein each playing area comprises:

thirty-one playing positions, arranged in seven rows, consisting of:

a central row consisting of one playing position, two first adjacent rows disposed parallel to each other and on opposite sides of the central row, said two first adjacent rows each consisting of three playing positions, two second adjacent rows disposed parallel to the first adjacent rows, and in a direction away from the central row, said second adjacent rows each consisting of five playing positions, and two third adjacent rows disposed parallel to the second adjacent rows, and in a direction away from the central row, said third adjacent rows each consisting of seven playing positions;

means for identifying the location of each playing position within each playing area; and means for relating the location of each playing position to the location of at least one other playing position in the same playing area such that those playing locations are defined as proximate playing locations.

17. A method of play for a board game, as recited in claim 12, wherein a player may declare a switch in lieu of making a move, thereby interchanging the identity of the first and second playing areas and reversing the direction of play.

18. A board game, as recited in claim 1, wherein the game additionally comprises printed matter setting forth a method of play therefor, which method may be identified as Rules of the Game.

* * * * *